US008928538B2

(12) United States Patent
Montgomery et al.

(10) Patent No.: US 8,928,538 B2
(45) Date of Patent: Jan. 6, 2015

(54) ANTENNA SYSTEM PROVIDING HIGH ISOLATION BETWEEN ANTENNAS ON ELECTRONICS DEVICE

(75) Inventors: Mark T. Montgomery, Melbourne Beach, FL (US); Frank M. Caimi, Vero Beach, FL (US); Paul A. Tornatta, Jr., Melbourne, FL (US)

(73) Assignee: Skycross, Inc., San Jose, CA (US)

( * ) Notice: Subject to any disclaimer, the term of this patent is extended or adjusted under 35 U.S.C. 154(b) by 1127 days.

(21) Appl. No.: 12/899,900

(22) Filed: Oct. 7, 2010

(65) Prior Publication Data

US 2011/0122035 A1 May 26, 2011

Related U.S. Application Data

(60) Provisional application No. 61/250,344, filed on Oct. 9, 2009, provisional application No. 61/363,085, filed on Jul. 9, 2010.

(51) Int. Cl.

| | |
|---|---|
| ***H01Q 21/28*** | (2006.01) |
| ***H01Q 1/52*** | (2006.01) |
| ***H01Q 1/22*** | (2006.01) |
| ***H01Q 1/24*** | (2006.01) |
| ***H01Q 9/22*** | (2006.01) |
| ***H01Q 9/26*** | (2006.01) |
| ***H01Q 9/28*** | (2006.01) |
| ***H01Q 9/42*** | (2006.01) |

(52) U.S. Cl.

CPC ..... *H01Q 1/2291* (2013.01); *H01Q 1/52* (2013.01); *H01Q 1/243* (2013.01); *H01Q 1/521* (2013.01); *H01Q 9/22* (2013.01); *H01Q 9/26* (2013.01); *H01Q 9/28* (2013.01); *H01Q 9/42* (2013.01); *H01Q 21/28* (2013.01)

USPC ..... 343/727; 343/702

(58) Field of Classification Search

CPC ..... H01Q 21/28; H01Q 21/24; H01Q 21/30; H01Q 1/52; H01Q 25/00; H01Q 1/24; H01Q 1/241; H01Q 1/242

USPC ..... 343/727, 702

See application file for complete search history.

(56) References Cited

U.S. PATENT DOCUMENTS

| | | | | |
|---|---|---|---|---|
| 5,189,434 | A * | 2/1993 | Bell | 343/853 |
| 8,044,863 | B2 * | 10/2011 | Ali et al. | 343/700 MS |
| 2003/0189518 | A1 * | 10/2003 | Johnson et al. | 343/702 |
| 2003/0189519 | A1 * | 10/2003 | Rutfors et al. | 343/702 |

(Continued)

OTHER PUBLICATIONS

International Search Report and Written Opinion for PCT/US2010/051779 dated Jun. 10, 2011.

*Primary Examiner* — Dameon E Levi
*Assistant Examiner* — Jennifer F Hu
(74) *Attorney, Agent, or Firm* — Guntin & Gust, PLC; Douglas Schnabel

(57) ABSTRACT

An antenna system is provided in a portable electronics device having a printed circuit board assembly. The antenna system includes a first antenna and a second balanced antenna provided on the printed circuit board assembly. The first antenna is fed from a portion of the printed circuit board assembly such that a ground plane of the printed circuit board assembly serves as a counterpoise for the first antenna. The second balanced antenna has dipole ends configured and oriented to generally minimize coupling to the ground plane of the printed circuit board assembly to increase isolation between the first antenna and the second balanced antenna.

27 Claims, 22 Drawing Sheets

(56) References Cited

U.S. PATENT DOCUMENTS

2007/0139276 A1 6/2007 Svigelj et al.
2007/0285319 A1* 12/2007 Ollikainen et al. ..... 343/702
2008/0012778 A1 1/2008 Mitsui
2008/0252538 A1 10/2008 Ying
2009/0124215 A1* 5/2009 Nysen ..... 455/90.1
2009/0153423 A1 6/2009 Dinallo et al.

* cited by examiner

ANTENNA SYSTEM PROVIDING HIGH ISOLATION BETWEEN ANTENNAS ON ELECTRONICS DEVICE

CROSS REFERENCE TO RELATED APPLICATIONS

This application claims priority from (1) U.S. Provisional Patent Application Ser. No. 61/250,344 filed on Oct. 9, 2009 and entitled "Balanced Antenna and Arrangement for Obtaining High Isolation between Antennas on the Same Electronics Device" and (2) U.S. Provisional Patent Application Ser. No. 61/363,085 filed on Jul. 9, 2010 and entitled "Antenna With Reduced Near-Field Radiation And Specific Absorption Rate (SAR) Values," both of which are hereby incorporated by reference.

BACKGROUND

The present application relates generally to antenna systems in portable electronics devices having two or more antennas operating simultaneously.

Portable electronics devices (e.g., USB Dongles and other wireless routers, cellular handsets, personal digital assistants, smart phones, and portable personal computers) typically include electronics components on a printed circuit board (PCB) assembly. Antennas for radio communications to and from such a device may be attached to the PCB assembly. For example, single-ended antennas may be fed directly from the PCB assembly, which then serves as a counterpoise for the antennas, allowing the antennas to be much smaller than otherwise possible. When the counterpoise is small (e.g., with dimensions on the order of the operating wavelength of the antennas or less), feeding two or more antennas from the same counterpoise can have the disadvantage of introducing too much coupling from one antenna to another. This is an example of a coexistence problem where more than one radio must operate at the same time from the same device.

One example of a device having two or more antennas fed from the same counterpoise is a portable wireless router device using a first radio for communication with a wide area network (WAN) using WiMAX in the 2500 to 2700 MHz band, and a second radio for local area network (LAN) communication using 802.11 (WiFi) protocols in the 2400 to 2500 MHz band. It is desirable to obtain as much isolation as possible between the antenna(s) connected to the WiMAX radio and the antenna(s) connected to the WiFi radio because the adjacent operating bands make the radios particularly vulnerable to interfering with each other.

Additionally, industrial design trends for portable electronics devices are driving slimmer form factors. At the same time, advanced communications systems using multiple-input, multiple-output (MIMO) signal processing techniques are driving multiple radio transmitters onto these platforms. The combination of two or more radios and a slim form factor creates significant difficulties in meeting Specific Absorption Rate (SAR) regulatory requirements.

BRIEF SUMMARY OF EMBODIMENTS OF THE INVENTION

In accordance with one or more embodiments, an antenna system is provided in a portable electronics device. The antenna system includes a first antenna and a second balanced antenna provided on the printed circuit board assembly of the portable electronics device. The first antenna is fed from a portion of the printed circuit board assembly such that a ground plane of the printed circuit board assembly serves as a counterpoise for the first antenna. The second balanced antenna has dipole ends configured and oriented to generally minimize coupling to the ground plane of the printed circuit board assembly to increase isolation between the first antenna and the second balanced antenna.

Various embodiments of the invention are provided in the following detailed description. As will be realized, the invention is capable of other and different embodiments, and its several details may be capable of modifications in various respects, all without departing from the invention. Accordingly, the drawings and description are to be regarded as illustrative in nature and not in a restrictive or limiting sense.

BRIEF DESCRIPTION OF THE DRAWINGS

Like reference numerals generally represent like parts in the drawings.

DETAILED DESCRIPTION

Various embodiments disclosed herein are directed to antenna systems for electronic communications devices having two or more antennas operating simultaneously. As discussed in greater detail below, the antenna system includes a printed circuit board assembly having a ground plane and a first antenna and a second balanced antenna provided on the printed circuit board assembly. The first antenna is fed from a portion of the printed circuit board assembly such that the ground plane of the printed circuit board assembly serves as a counterpoise for the first antenna. The second balanced antenna has dipole ends configured and oriented to generally minimize coupling to the ground plane of the printed circuit board to increase isolation between the first antenna and the second balanced antenna. In one or more embodiments, the peak near fields created by each antenna do not substantially overlap, thereby reducing the increase in SAR that may otherwise occur when both antennas are used to transmit simultaneously.

FIGS. 1A-1D illustrate an antenna system assembly 100 in accordance with one or more embodiments. In this example, the assembly comprises a 60×100 mm PCB 102 and three antennas. The PCB 102 is representative of a PCB that may be used to hold the electronics of a portable WiMAX/WiFi device. Two WiMAX antennas 104 are attached to one end of the PCB 102. The WiMAX antennas 104 are fed from the edge of the PCB 102 (at feed points 110) such that the ground plane 108 of the PCB 102 serves as the counterpoise for both antennas 104.

Figure 1A:
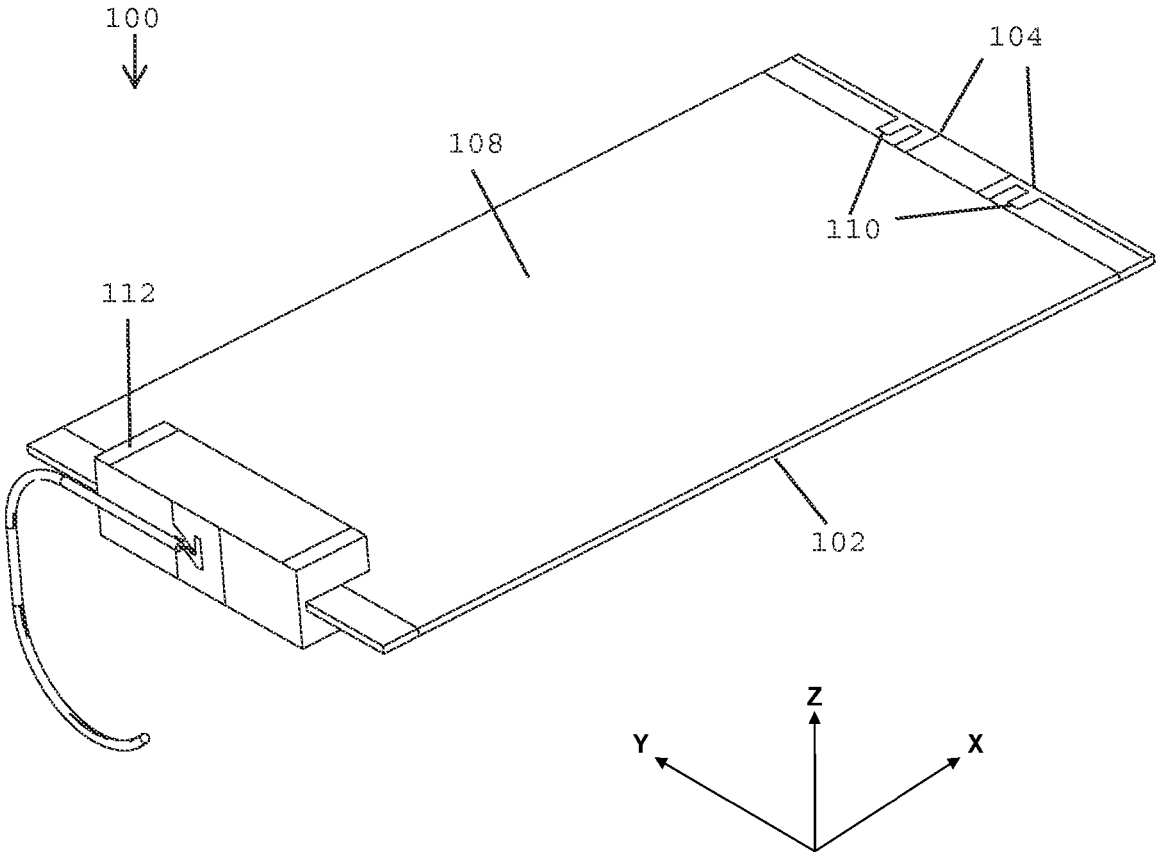
FIG. 1A is a perspective view of an exemplary antenna system in accordance with one or more embodiments.
Figure 1B:
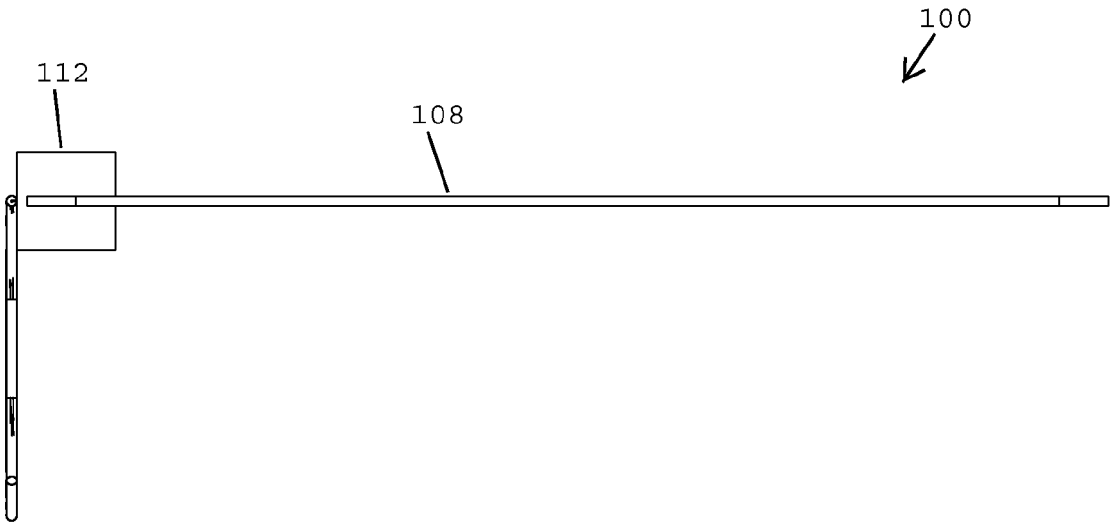
FIG. 1B is a cross section view of the antenna system of FIG. 1A.
Figure 1C:
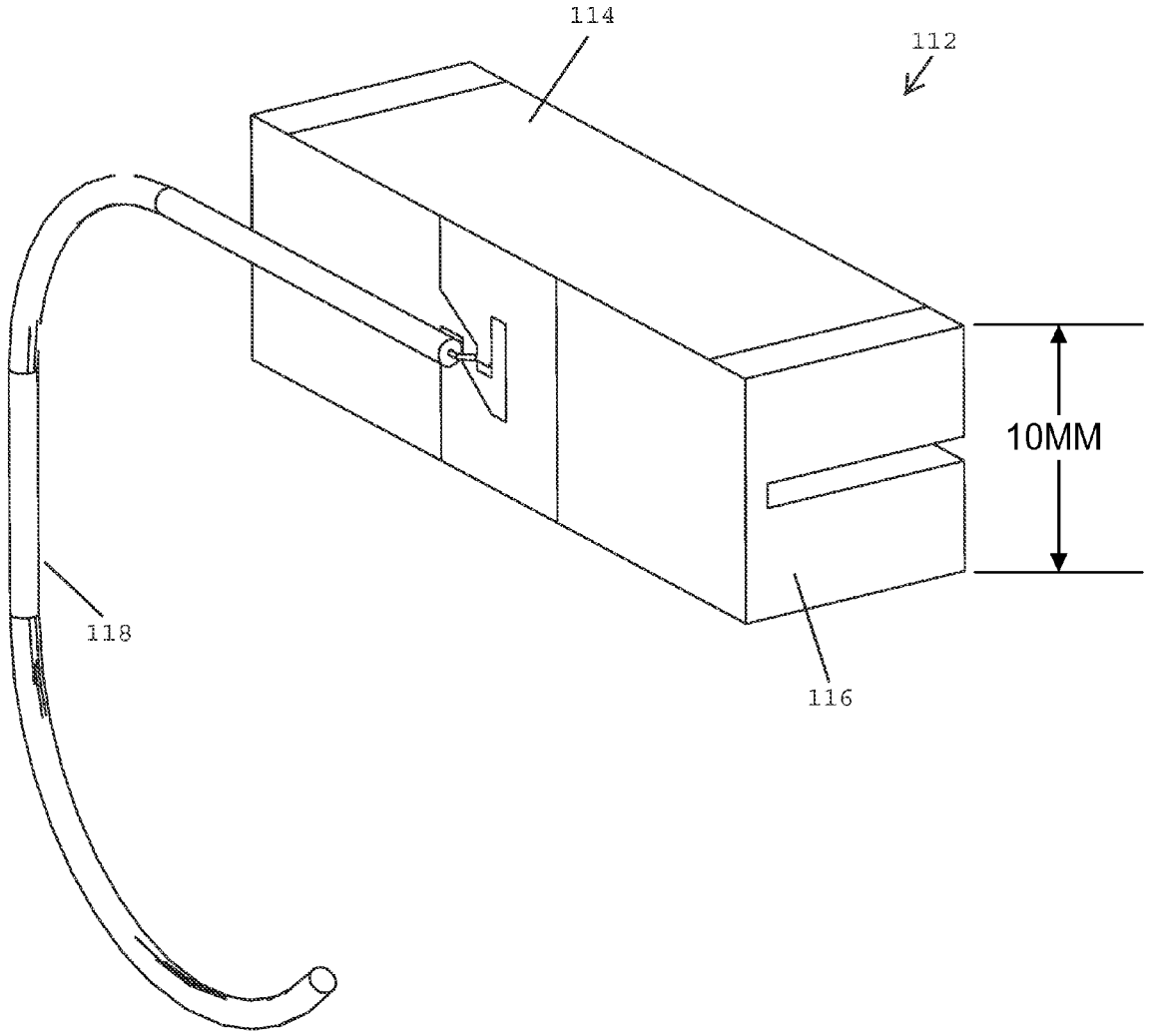
FIG. 1C is an enlarged perspective view of the balanced antenna shown in FIG. 1A.

A third balanced antenna 112, generally optimized for operation in the WiFi frequency band, is located at the opposite end of the PCB 102. The antenna 112, shown in the side cross-section view of FIG. 1B and isometric view of FIG. 1C, is formed using a copper foil pattern 114 applied to a plastic supporting piece or carrier 116. Connection to the feed point can be made with a 1.1 mm diameter coaxial cable 118. A feed terminal 120 is connected to the shield of the coaxial cable 118, and a feed terminal 122 is connected to the center conductor of the coaxial cable 118. The balanced antenna 112 is oriented to produce far E-field polarization normal to the ground plane 108. Referring to FIG. 1A, the PCB 102 and associated ground plane 108 lie in the X-Y plane, and the balanced antenna 112 is oriented to produce far E-field polarization aligned with the Z-axis.

Figure 1D:
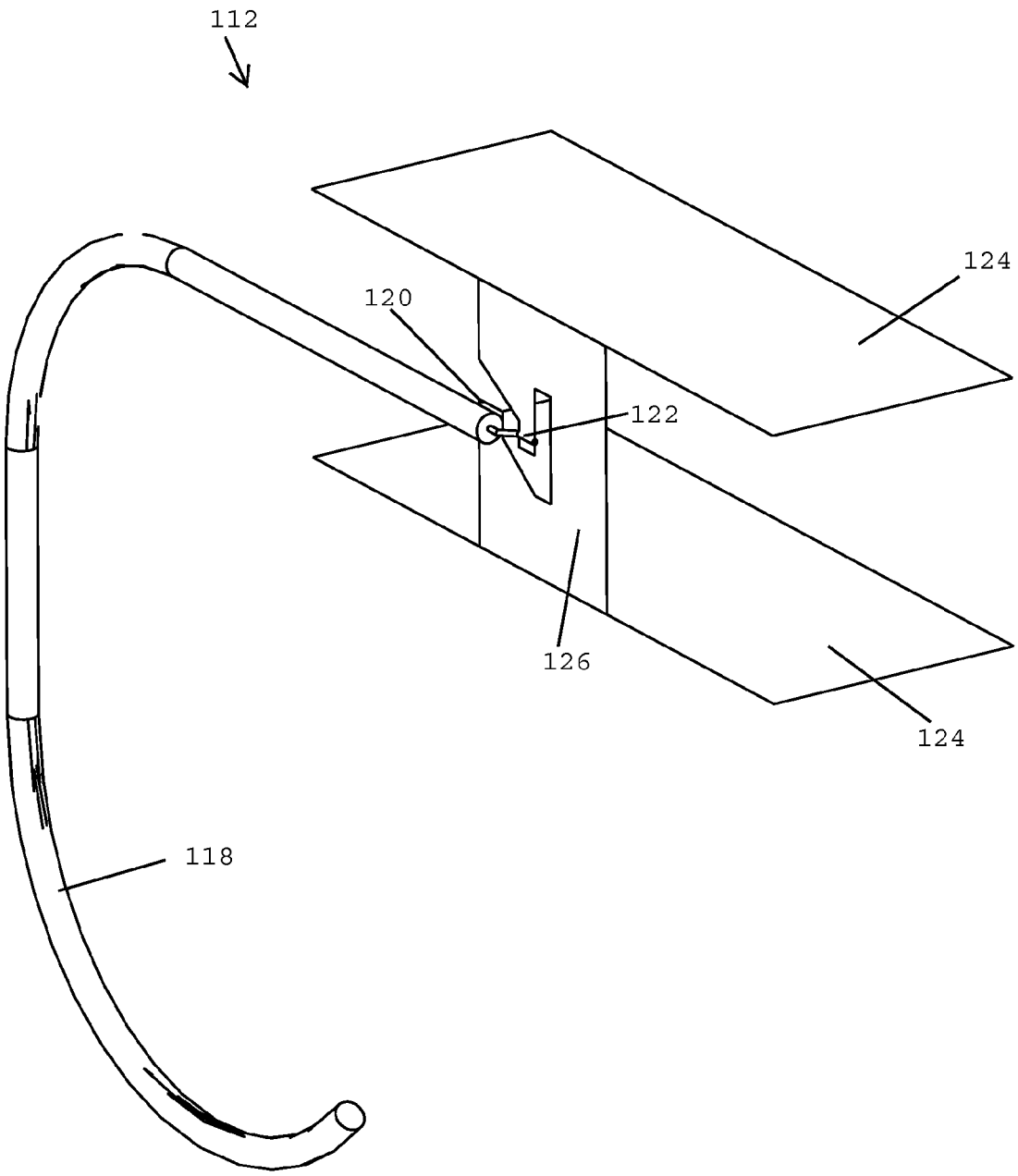
FIG. 1D is an enlarged perspective view of the balanced antenna of FIG. 1C with the carrier removed for purposes of illustration.

FIG. 1D shows the WiFi antenna 112 with the carrier 116 removed for purposes of illustration. The antenna 112 comprises a center-fed dipole with capacitive end plates 124 and an inductive connection 126 between ends. The end plates 124 serve to lower the resonant frequency of the antenna 112 so that the antenna 112 can be much shorter than the nominal half-wavelength dipole. A short dipole has lower input impedance than a half-wave dipole and the inductive connection serves to increase the real input impedance of the antenna 112 to match to 50-ohms. In this example, the antenna height, or z-axis dimension, is 10 mm or 1/12 wavelength at 2500 MHz, making it amenable to embedding within a low-profile product.

Because the antenna 112 is balanced, it does not require connection to a counterpoise. Nonetheless even if the antenna 112 is not intentionally connected to the PCB ground 108, it will readily couple to the PCB ground 108 through near field interaction without specific arrangement avoid this effect. To reduce coupling, the antenna 112 is placed generally symmetrically about the PCB ground 108 in the z-axis, as can be seen from the side view of the assembly of FIG. 1B. In this way, the dipole ends, which are at electric potentials of equal magnitude but opposite sign, are equidistant from the ground plane 108 and result in neutral potential at the ground plane 108, and consequentially the net coupling to the ground plane is zero. If the dipole is offset in the z-axis, then a net potential can be imparted to the end of the ground plane 108. This could undesirably couple to horizontal resonance modes of the ground plane 108 and hence to the antennas 104 for which the ground plane 108 is serving as counterpoise, and thereby couple the antennas 104, 112.

Figure 3A:
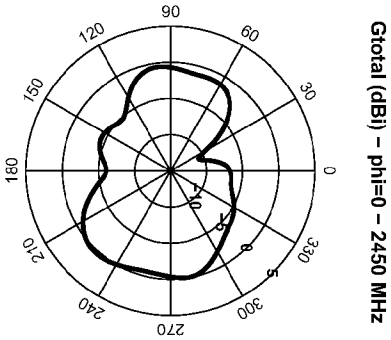
FIGS. 3A-3C illustrate measured radiation patterns for the balanced antenna of the antenna system of FIG. 1A.
Figure 3B:
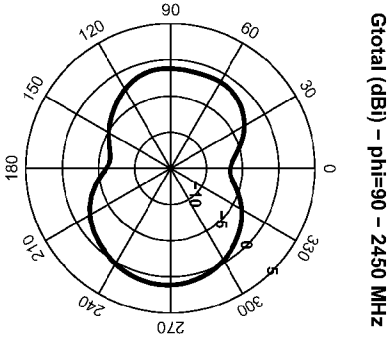
Figure 3C:
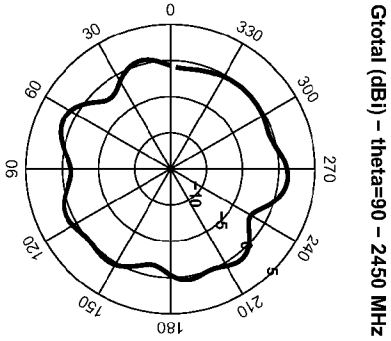

The design and arrangement of the balanced antenna 112 to avoid coupling to the PCB ground 108 has several advantages, including, as stated above, that the coupling to other antennas 104 that already interact with the PCB ground 108 is reduced. In addition, the pickup of noise or other unwanted conducted signals from the PCB ground 108 is also reduced. Furthermore, scattering by the PCB ground 108 is reduced, such that the embedded dipole maintains the omni-directional azimuth pattern of a free-space dipole. Refer to the theta=90 degrees plot of the measured radiation patterns for the balanced antenna 112 provided in FIG. 3C.

Figure 2A:
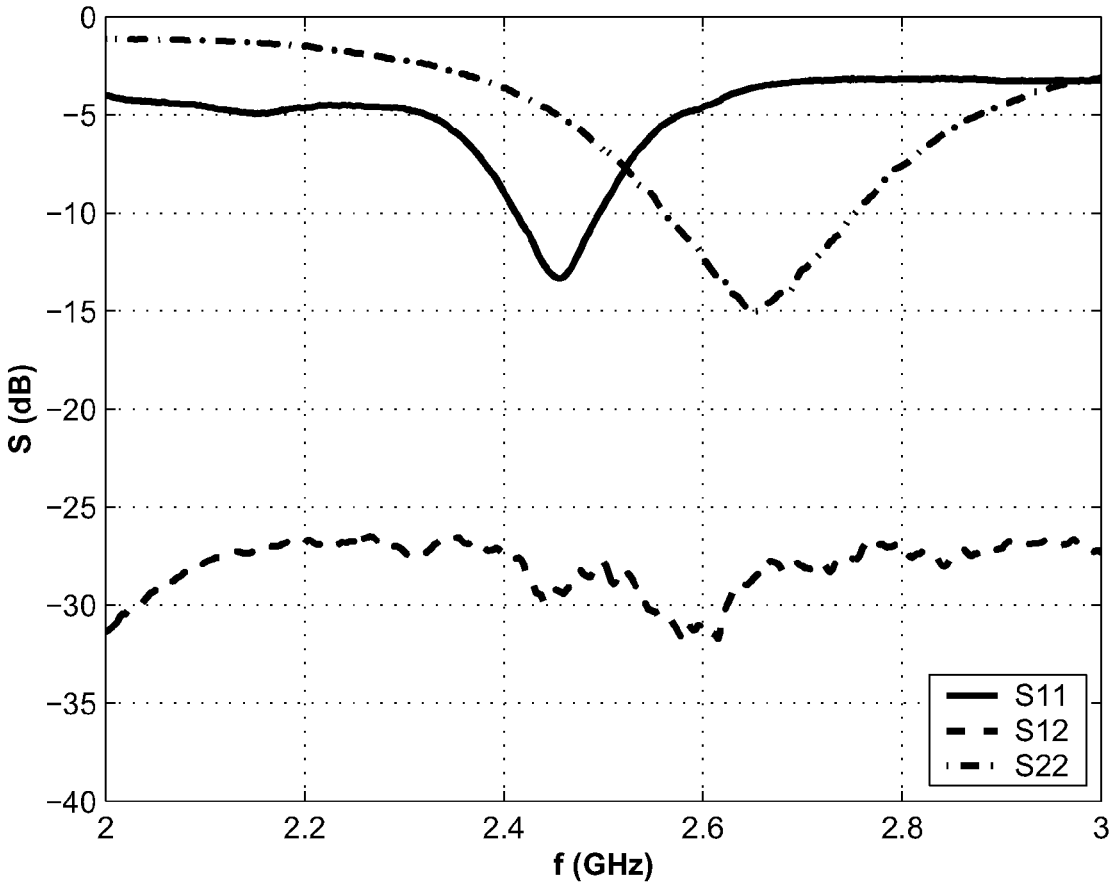
FIGS. 2A-2C are graphs illustrating return loss and coupling measured between the test ports of the antenna system of FIG. 1A.
Figure 2B:
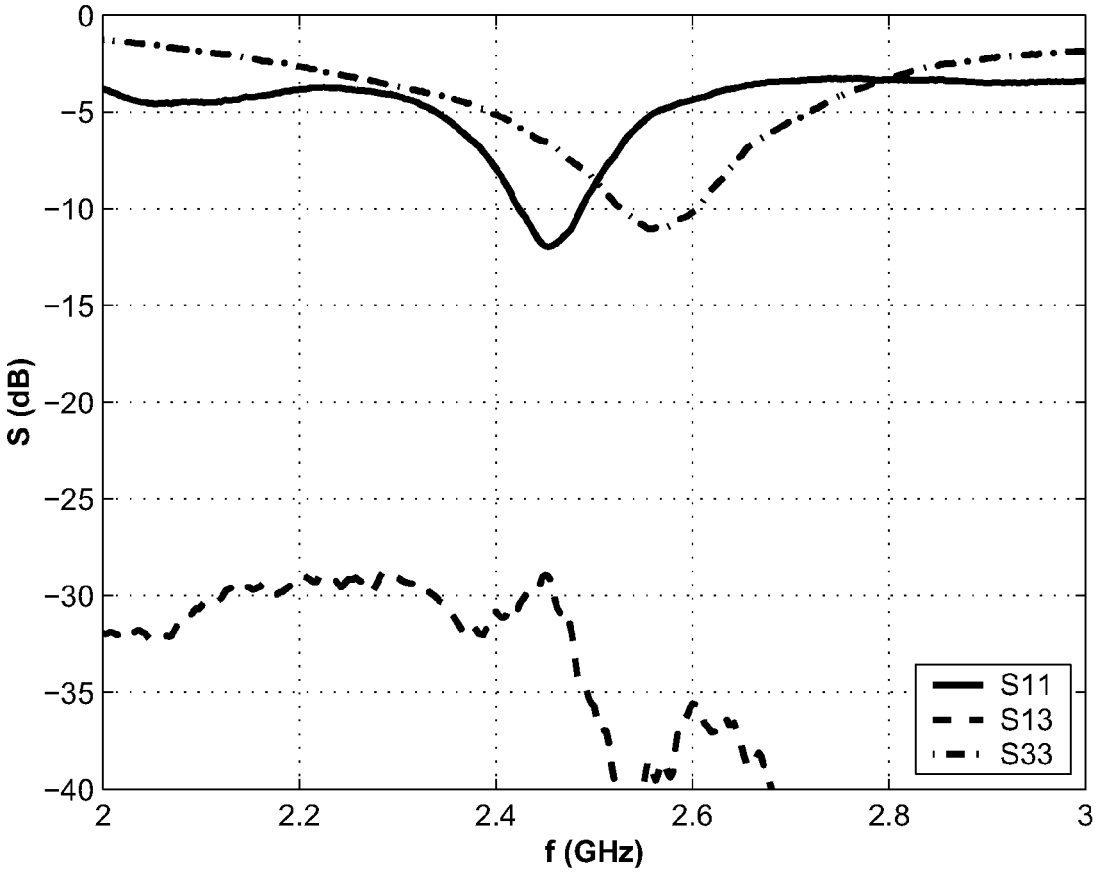
Figure 2C:
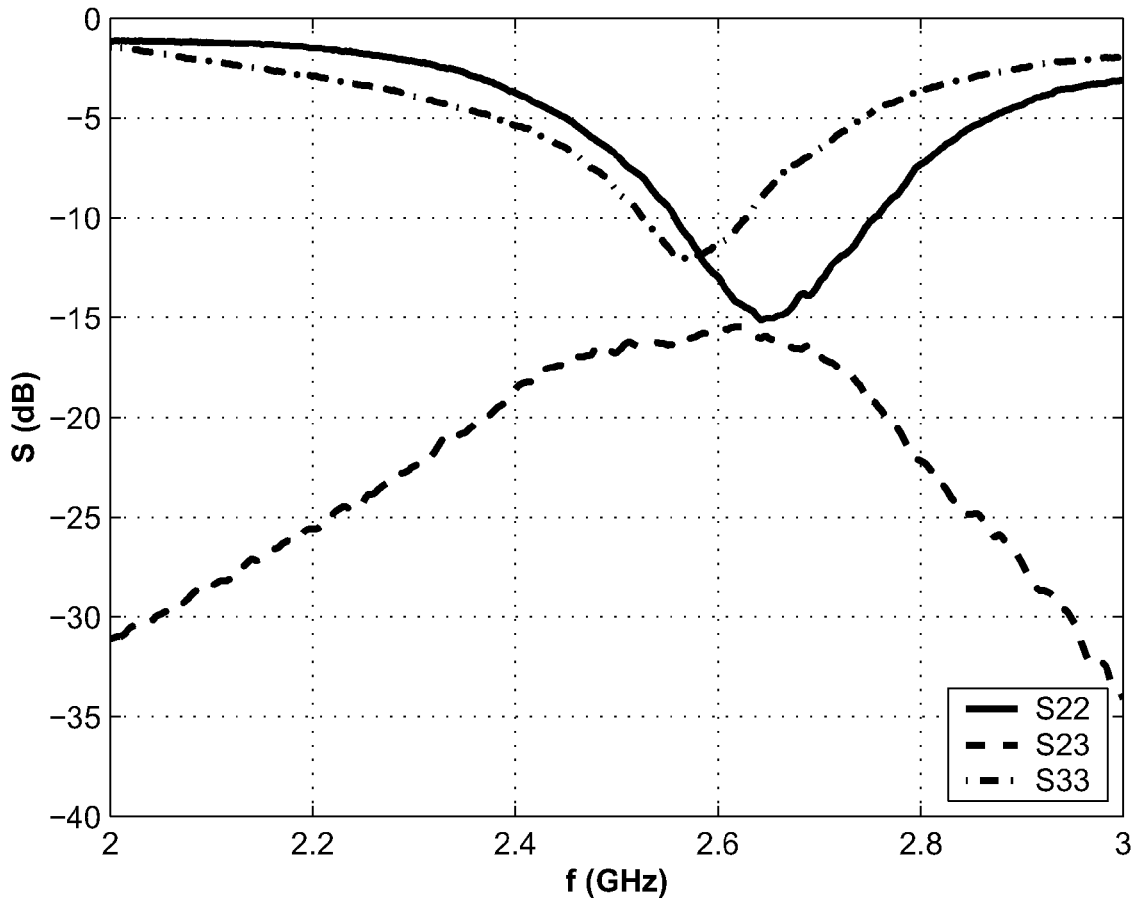

Plots of measured S parameters for a prototype of the assembly of FIG. 1A are shown in FIGS. 2A-2C. For these plots, the Port 1 is connected to the balanced antenna 112 and Ports 2 and 3 are connected to the WiMAX antennas 104. Coupling between the balanced antenna 112 and WiMAX antennas 104 (S12 and S13) is between −28 and −40 dB. By contrast, coupling between the two WiMAX antennas 104 on the PCB is about −15 dB.

Figure 4:
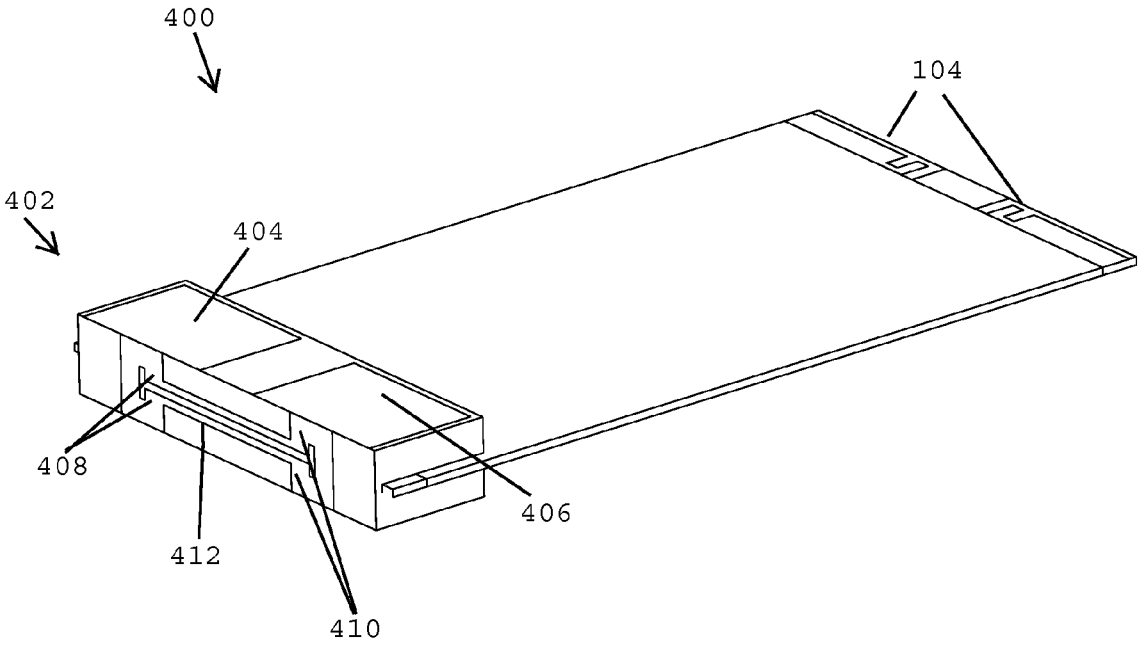
FIG. 4 is a perspective view of an alternative antenna system in accordance with one or more embodiments.

FIG. 4 illustrates an antenna system 400 in accordance with one or more alternate embodiments, which uses the same two WiMAX antennas 104 but with a two-port balanced WiFi antenna 402. The two-port balanced antenna 402 is a two-port antenna designed to provide generally optimal isolation between the two WiFi ports and is similar to antennas described in U.S. Pat. Nos. 7,688,273 and 7,688,275, the contents of which are hereby incorporated by reference herein. In general, the second balanced antenna 402 includes two antenna elements 404, 406, each operatively coupled to a respective antenna port 408, 410. A connecting element 412 electrically connects the antenna elements 404, 406 such that electrical currents on one antenna element flow to the other antenna element and generally bypass the antenna port coupled to the other antenna element. The electrical currents flowing through each antenna element are generally equal in magnitude, such that an antenna mode excited by one antenna port is generally electrically isolated from a mode excited by the other antenna port at a given desired signal frequency range.

In the FIG. 4 example, the balanced antenna 402 is designed to produce z-axis polarization, with low profile (10 mm height) and symmetry about the plane of the PCB ground.

Figure 5A:
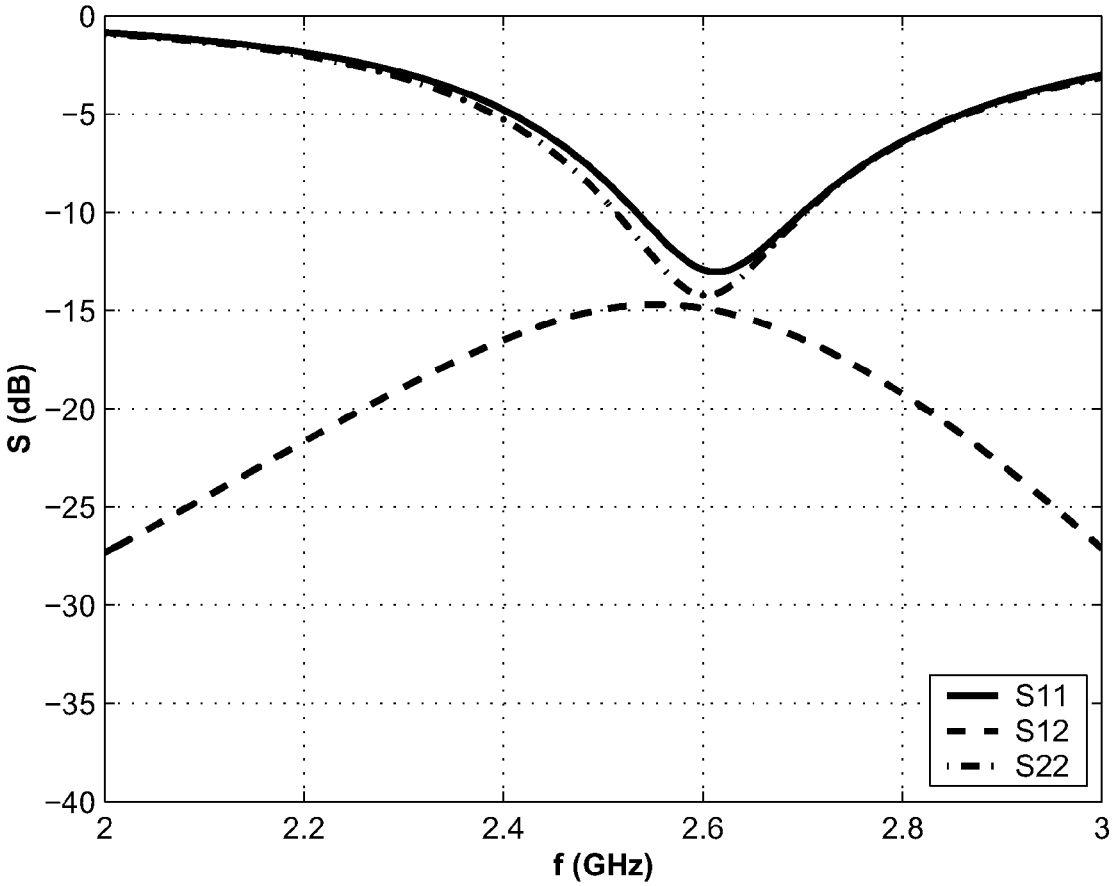
FIGS. 5A-5D are graphs illustrating return loss and coupling measured between the test ports of the antenna system of FIG. 4.
Figure 5B:
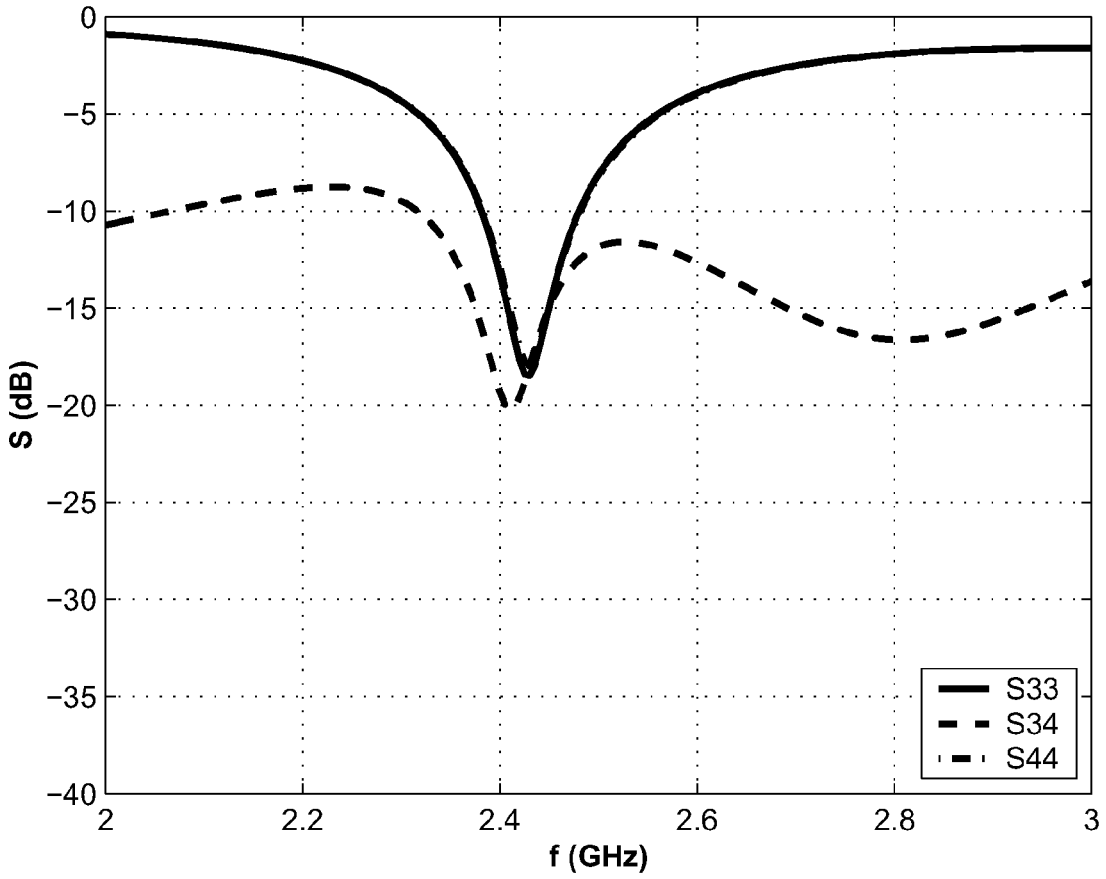
Figure 5C:
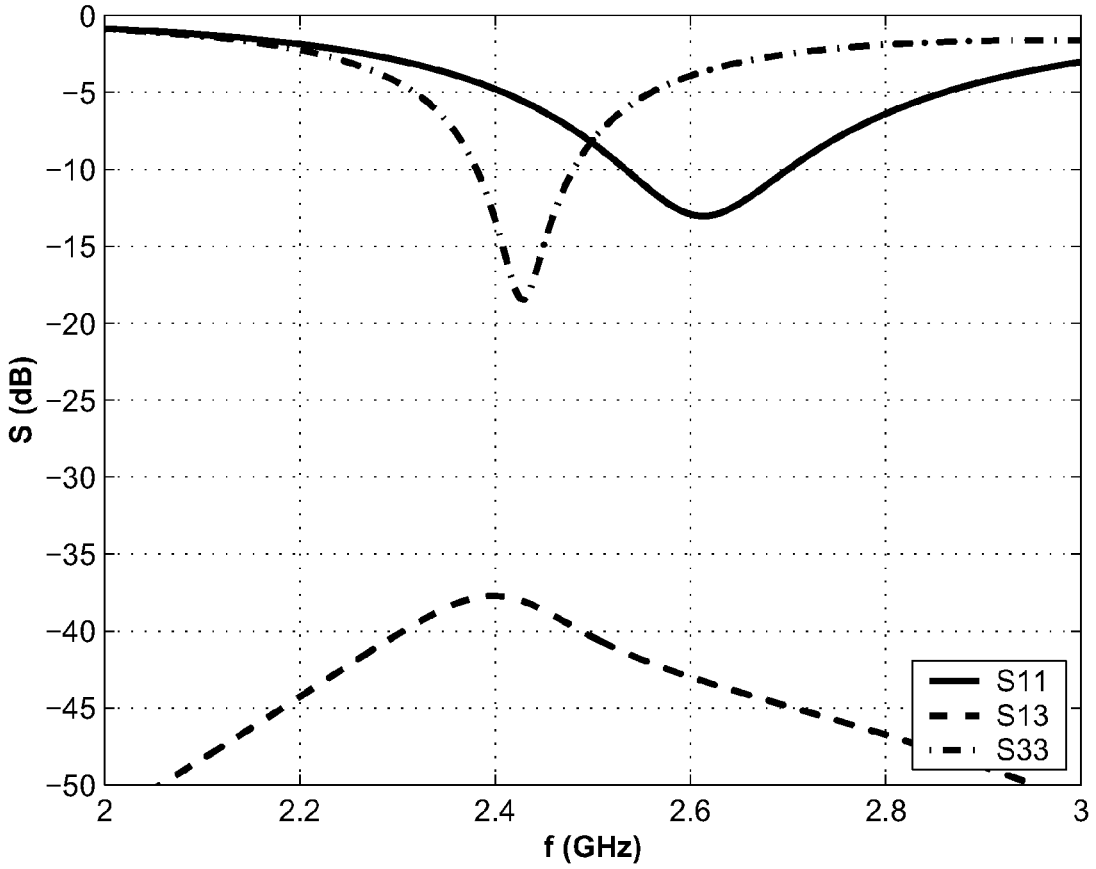
Figure 5D:
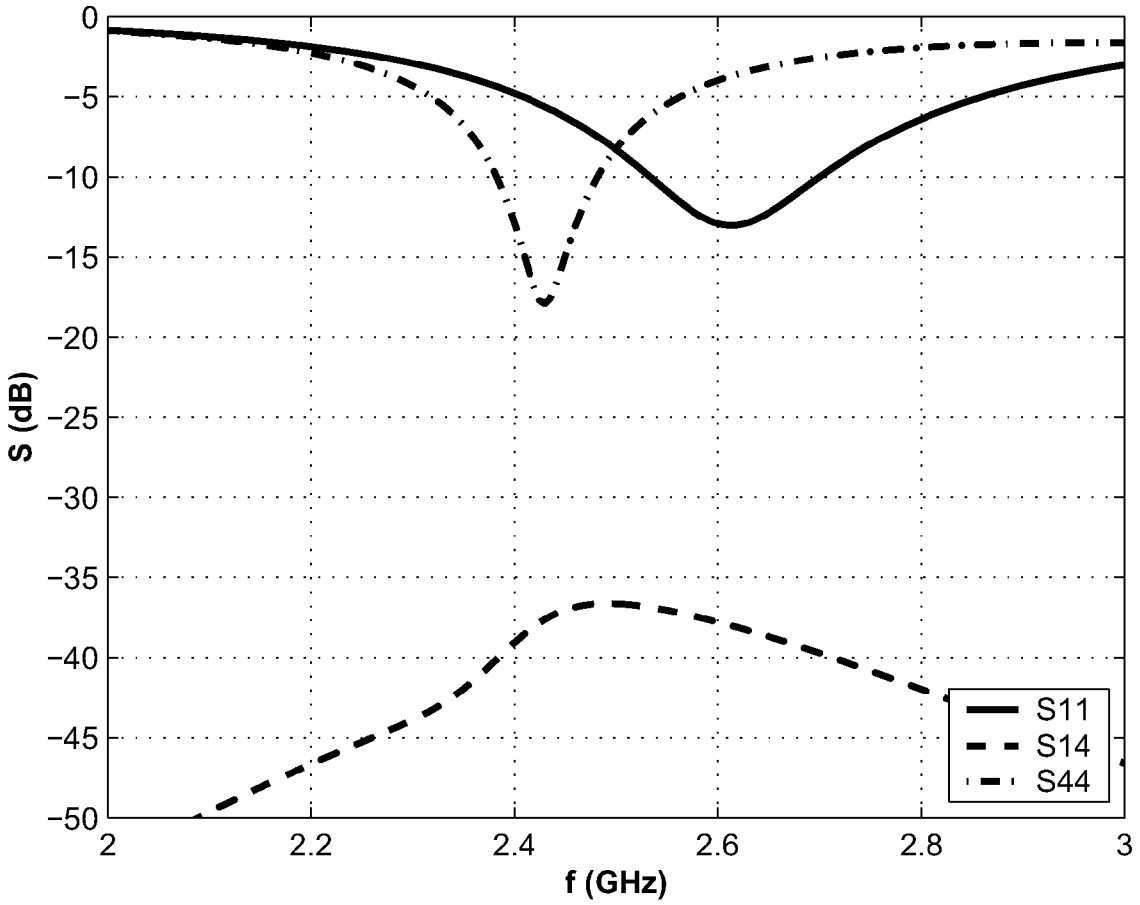

Plots of simulated S parameters for a model of the assembly of FIG. 4 are included as FIGS. 5A-5D. For these plots, the Ports 1 and 2 are connected to the WiMAX antennas, and Ports 3 and 4 are connected to the balanced two-port antenna. Coupling between the WiMAX antennas (S12) is about −15 dB as before (FIG. 5A). For the two-port antenna, both ports are well matched and have enhanced isolation over the WiFi band (2400 to 2500 MHz). The coupling between WiMAX and either WiFi antenna port is less than 35 dB (FIGS. 5C and 5D). This antenna configuration therefore provides adequate isolation for co-existence between WiFi and WiMAX radios, while allowing full MIMO or diversity operation within the 802.11n or 802.11b protocols.

Figure 6A:
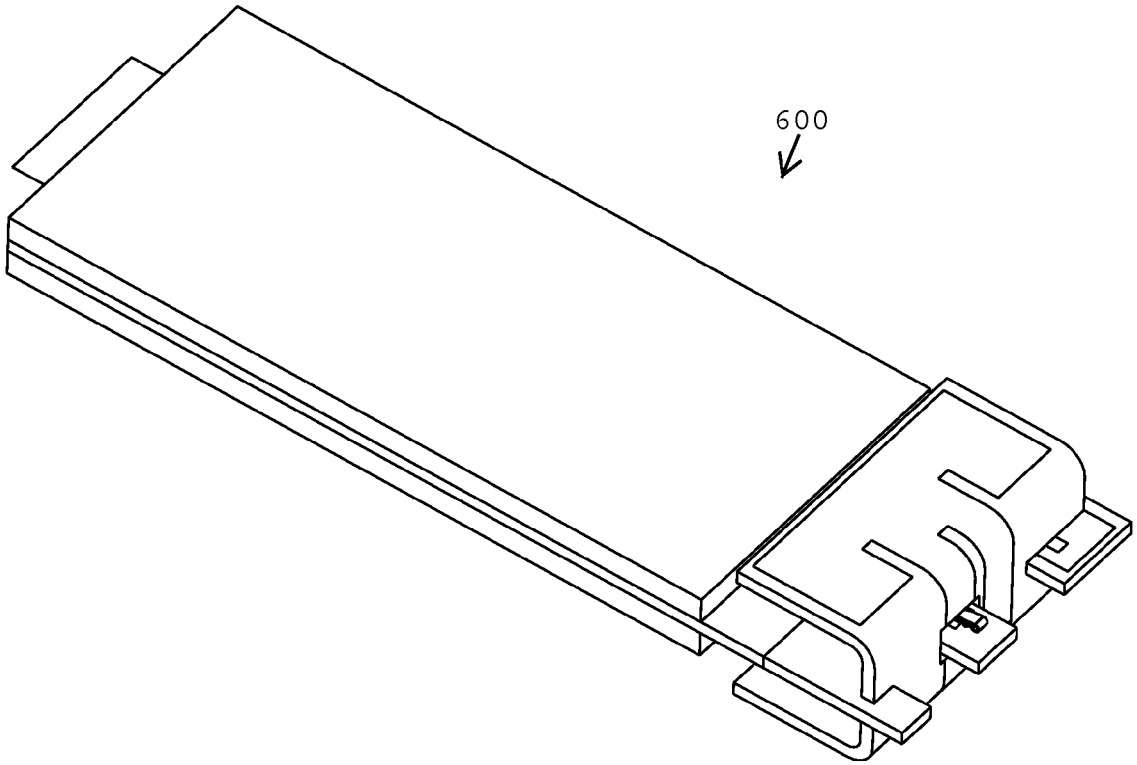
FIG. 6A is a perspective view of an alternate antenna system in accordance with one or more embodiments.
Figure 6B:
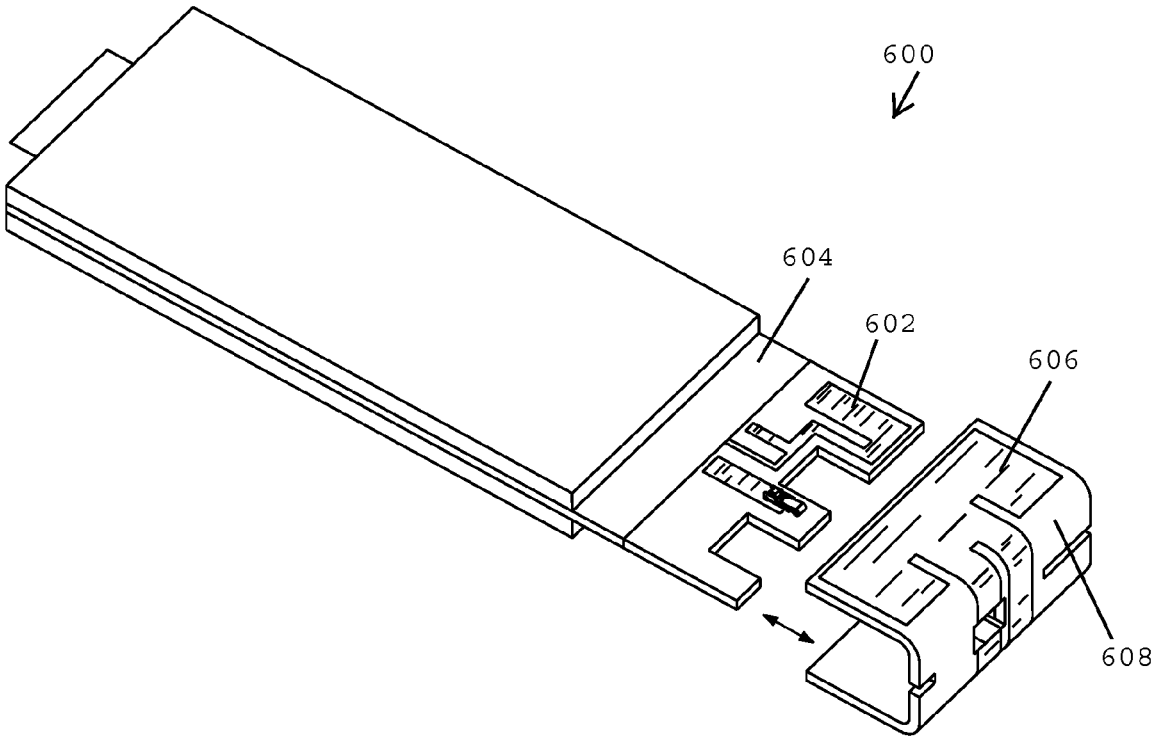
FIG. 6B is a perspective view of the antenna system of FIG. 6A showing the balanced antenna separated from the printed circuit board assembly for purposes of illustration.
Figure 6C:
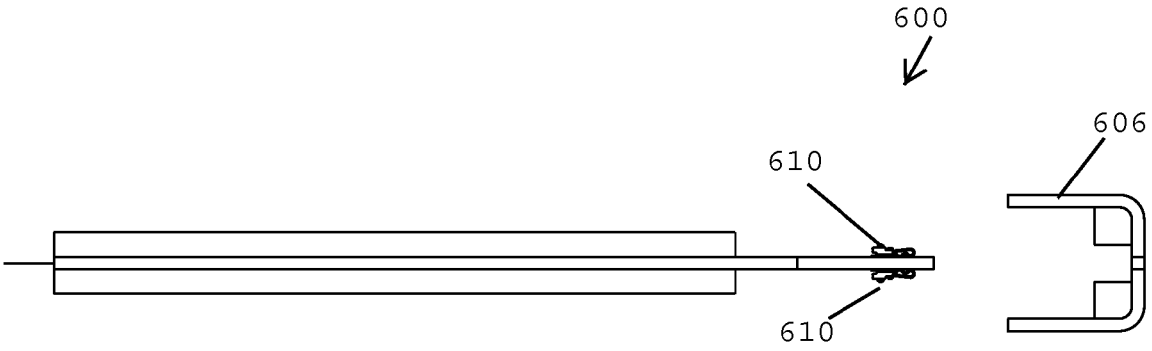
FIG. 6C is a cross-section view of the antenna system of FIG. 6A showing the balanced antenna separated from the printed circuit board assembly for purposes of illustration.
Figure 7A:
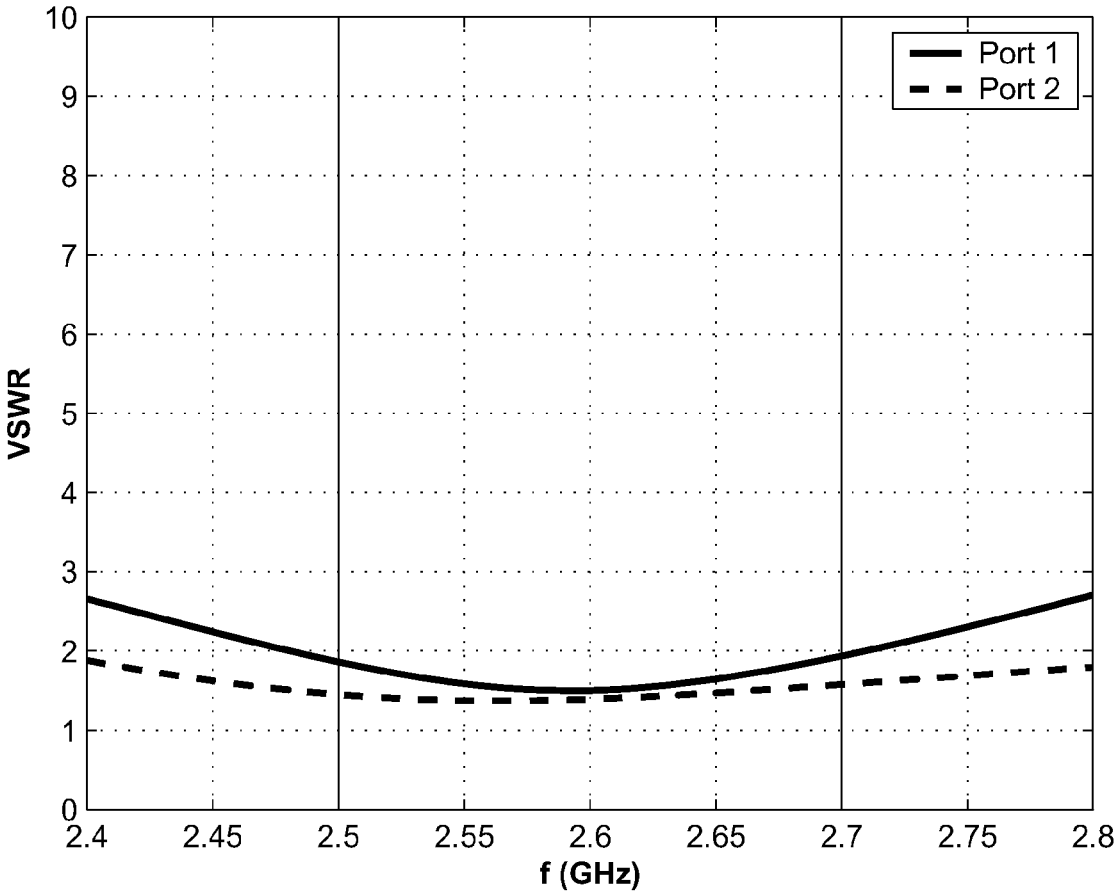
FIGS. 7A-7D are graphs illustrating various antenna performance parameters for the antenna system of FIG. 6A.
Figure 7B:
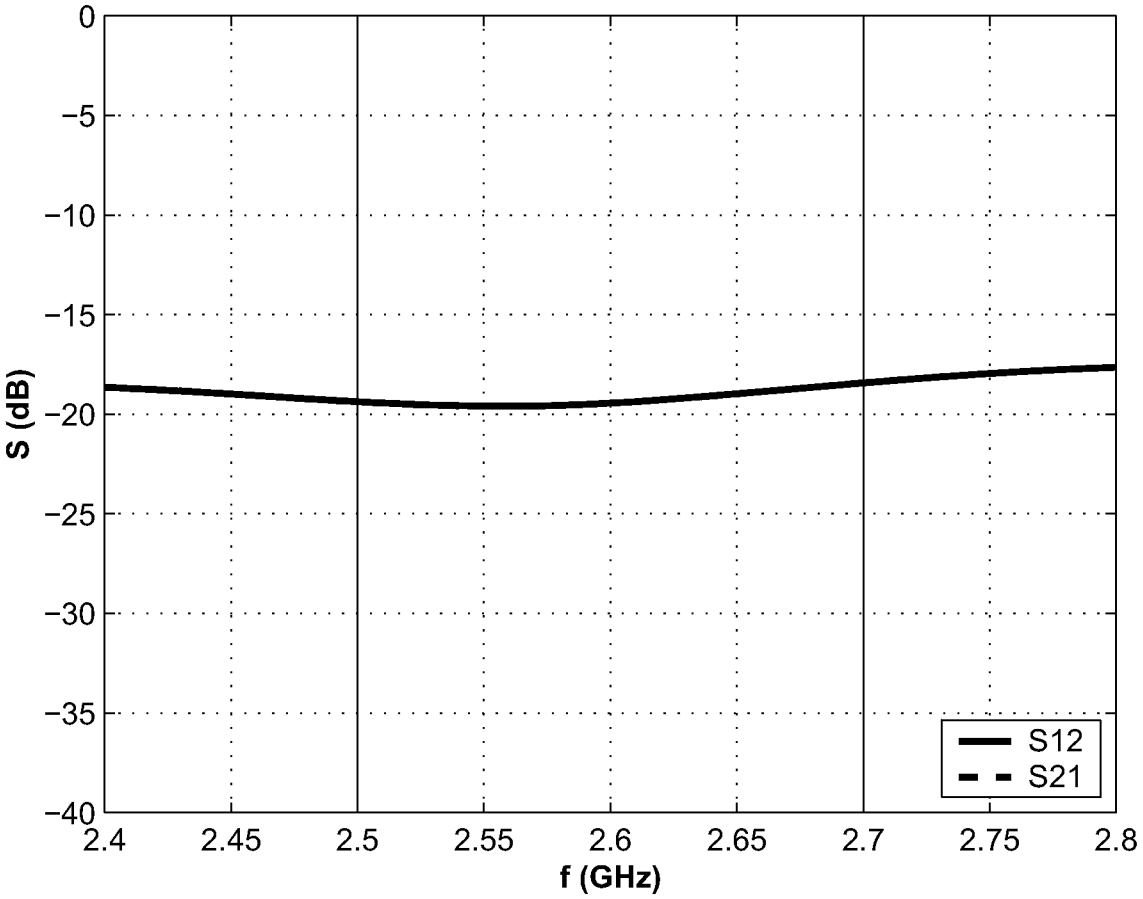
Figure 7C:
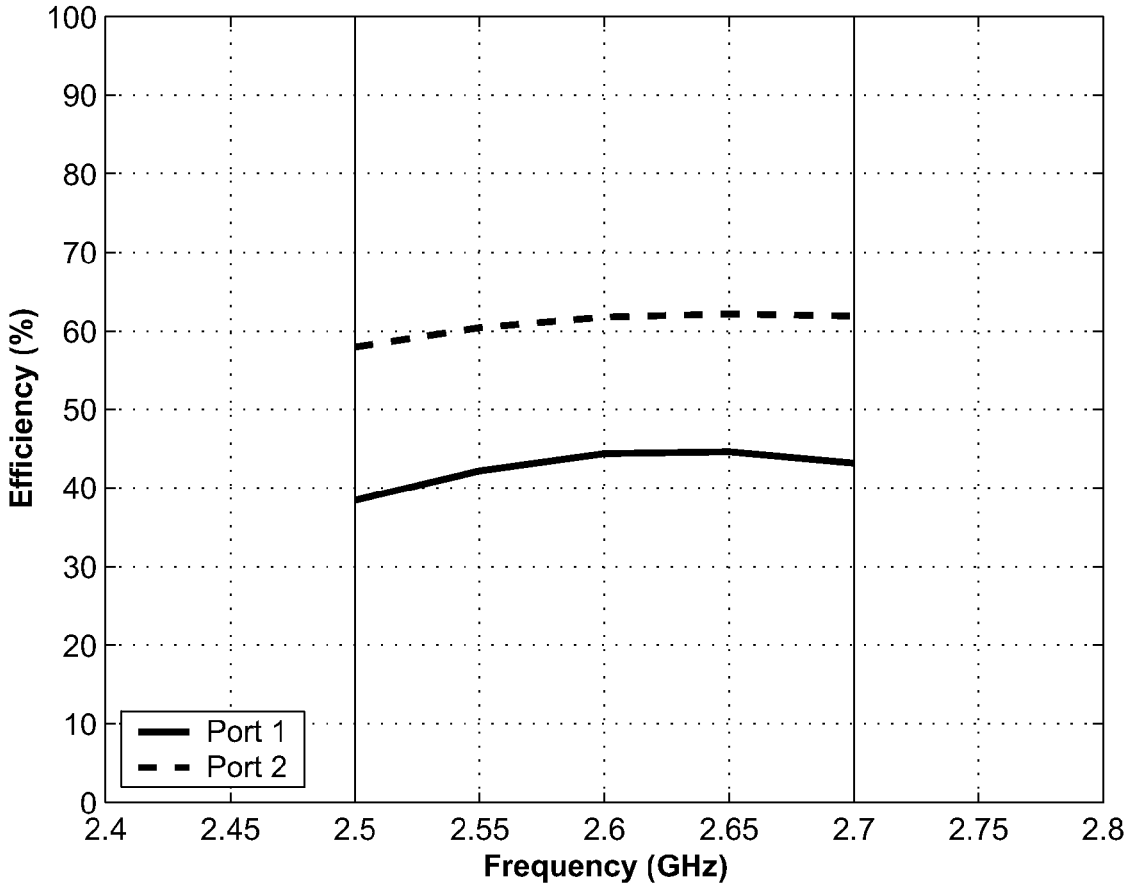
Figure 7D:
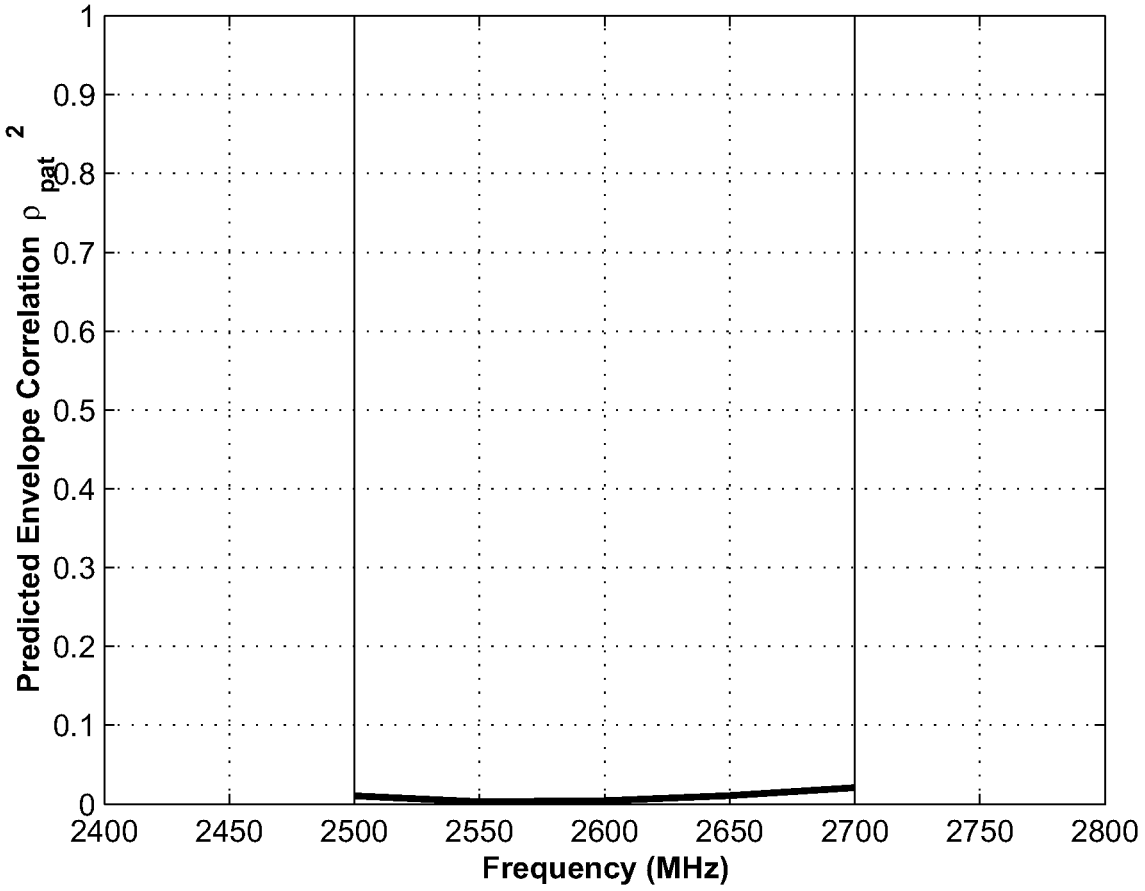

FIGS. 6A-6C illustrate an antenna system 600 in accordance with one or more further embodiments. The antenna system can be used, e.g., in a USB dongle assembly for communication over WiMAX. The antenna system 600 includes a printed antenna 602 (that uses the ground plane 604 of a printed circuit board assembly as a counterpoise) and a balanced antenna 606. Both antennas are located at the same end of the PCB assembly as shown in FIG. 6B. The balanced antenna 606 in this example is formed by wrapping a flexible printed circuit (FPC) onto a plastic carrier 608. The plastic carrier 608 can be slid onto the end of the PCB. Spring contacts 610 on the top and bottom side of the PCB provide connection to the feed and ground terminals of the balanced antenna, respectively, as depicted in FIG. 6C.

Plots of antenna performance parameters VSWR, S12, efficiency, and antenna cross-correlation are provided as FIGS. 7A-7D. These plots demonstrate good performance across the entire band from 2500 to 2700 MHz.

Figure 8:
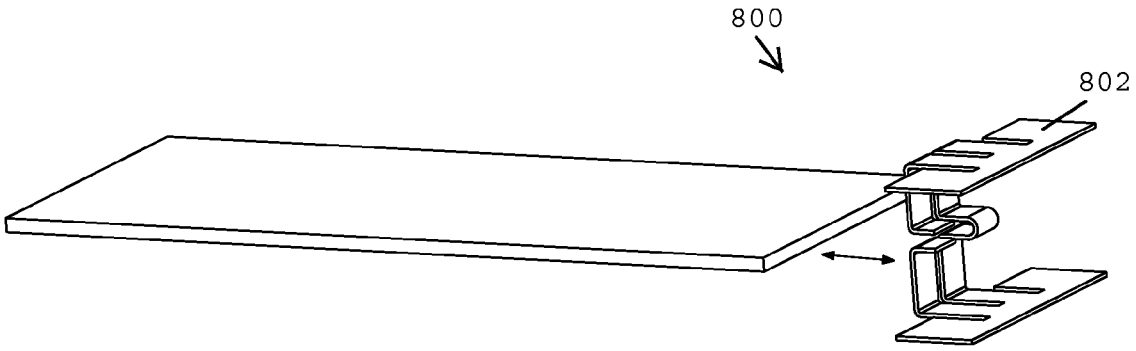
FIG. 8 is a perspective view of an antenna system in accordance with one or more alternate embodiments.

FIG. 8 is a perspective view of an alternate antenna system 800 in accordance with one or more embodiments. The antenna system 800 includes a balanced antenna 802 that is formed from a single piece of stamped metal. The balanced antenna can be attached to the PCB, e.g., by sliding it onto the PCB. For simplicity, antennas coupled to the ground plane of the printed circuit board are not shown in FIG. 8.

Figure 9:
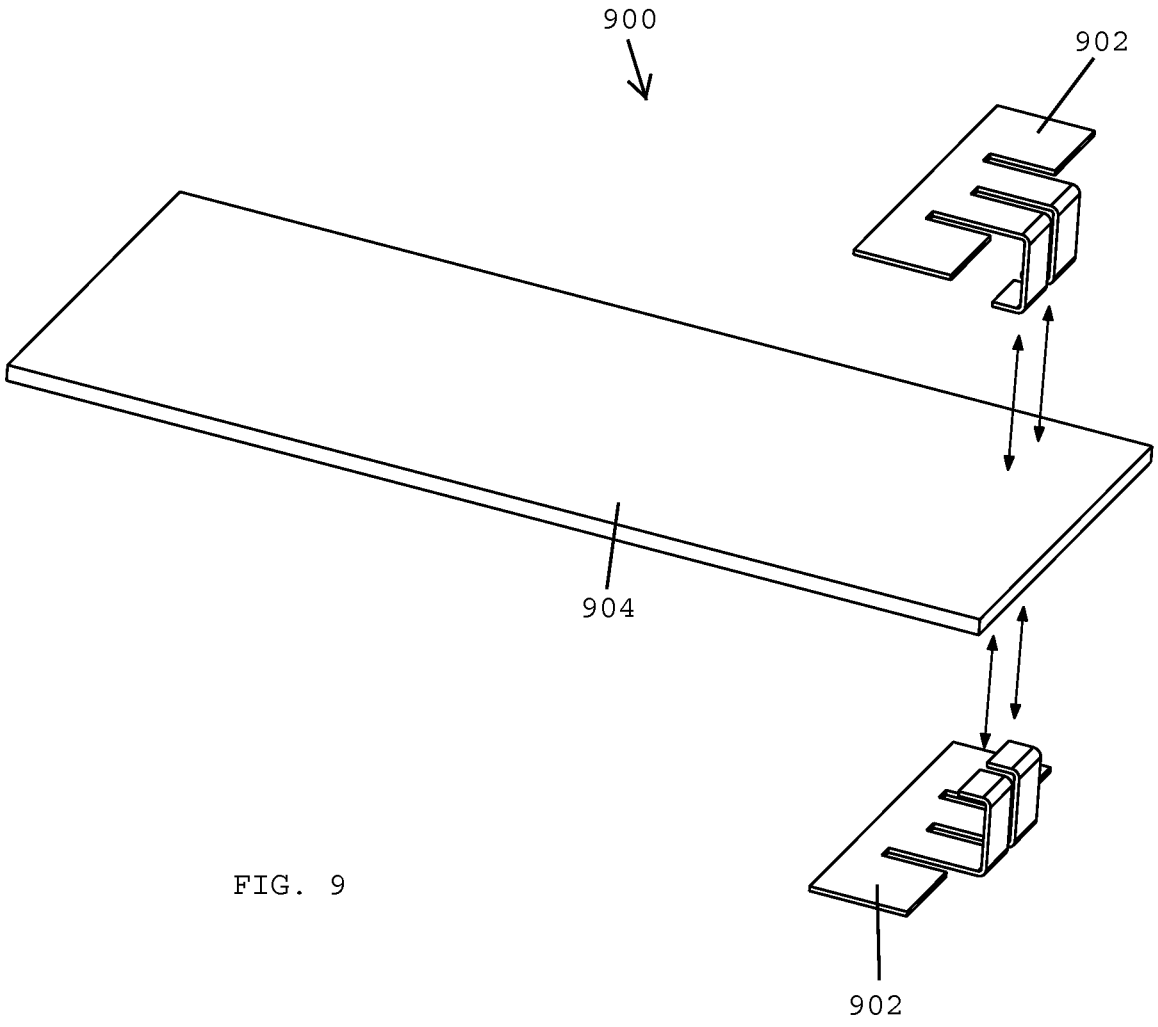
FIG. 9 is a perspective view of an antenna system in accordance with one or more alternate embodiments.

FIG. 9 is a perspective view of another alternative antenna system 900 in accordance with one or more embodiments. The antenna system includes a balanced antenna that is formed from two pieces of stamped metal 902, each forming a half of the balanced antenna. A balanced antenna is completed by attaching the two pieces 902 (e.g., by soldering) to the top and bottom sides of a PCB 904. Each antenna piece has two legs. The legs on one side of the stamped pieces are soldered to pads on the PCB 904 that are connected together. The connected pads thereby complete the inductive connection between the top and bottom halves 902 of the balanced antenna. The ends of the legs on the other side of the pieces serve as the antenna feed terminals. One terminal is attached to the top side of the PCB 904 and the opposite terminal is attached to the bottom side of the PCB 904. For simplicity, antennas coupled to the ground plane of the printed circuit board are not shown in FIG. 9.

Another advantage of antenna systems in accordance with various embodiments is that they produce reduced SAR values for devices that simultaneously transmit from two antennas, thereby facilitating compliance with SAR regulations.

It is common for two or more antennas in portable electronics devices to use the PCB ground plane as a counterpoise. Since the PCB ground plane is typically the largest conductor in the device, it tends to dominate the radiation environment. The near field distribution is also dominated by this feature. If two antennas are coupled to the same ground plane and are in close proximity to each other (i.e., less than a quarter of a wavelength apart), their near-field distributions will be largely overlapping. Connecting two transmitters, one to each antenna, will effectively double the resultant near-field (as compared to a single transmitter). In turn, the SAR values will also double.

This problem is mitigated by antenna systems in accordance with various embodiments because they provide increased isolation between antennas (one coupled to the main PCB ground as a counterpoise and a separate antenna that is balanced on and is not coupled into the PCB ground). The antenna system is configured such that the resultant near field distribution created by each antenna does not substantially overlap. As mentioned above, SAR values can double for overlapping near fields. However, SAR values are reduced in exemplary embodiments, e.g., to 1.5 times that of a single transmitter, which is preferable and is achieved from an antenna configuration that reduces the overlapping region of the near-field from each antenna.

By way of example, in the antenna system of FIG. 6A, the peak SAR locations of the printed antenna and those for the balanced antenna are generally not coincident. In particular, for the printed antenna, the peak SAR is found around a circumference about the PCB assembly near the location between the antenna and the grounded PCB assembly. On the other hand, the peak SAR location for the balanced antenna is off the end of PCB assembly.

It is to be understood that although the invention has been described above in terms of particular embodiments, the foregoing embodiments are provided as illustrative only, and do not limit or define the scope of the invention. Various other embodiments, including but not limited to the following, are also within the scope of the claims. For example, elements and components described herein may be further divided into additional components or joined together to form fewer components for performing the same functions.

Having described preferred embodiments of the present invention, it should be apparent that modifications can be made without departing from the spirit and scope of the invention.

The invention claimed is:

1. In a portable electronics device having a printed circuit board assembly, an antenna system comprising:

a first antenna provided on the printed circuit board assembly, the first antenna being fed from a portion of the printed circuit board assembly such that a ground plane of the printed circuit board assembly serves as a counterpoise for the first antenna; and a second balanced antenna provided on the printed circuit board assembly, wherein the second balanced antenna has dipole ends being excitable to an electrical potential of equal magnitude and opposite sign, resulting in an approximately neutral potential at the ground plane to approximately minimize coupling to the ground plane of the printed circuit board assembly to increase isolation between the first antenna and the second balanced antenna, and wherein the dipole ends are oriented such that an axis of polarization is approximately normal to the ground plane of the printed circuit board assembly.

2. The antenna system of claim 1 wherein the first antenna and the second balanced antenna are provided at opposite ends of the printed circuit board assembly.

3. The antenna system of claim 1 wherein the first antenna and the second balanced antenna are provided at a same end of the printed circuit board assembly.

4. The antenna system of claim 1 wherein the second balanced antenna comprises a conductive foil pattern printed on a carrier attached to the printed circuit board assembly.

5. The antenna system of claim 1 wherein the second balanced antenna comprises a stamped metal part.

6. The antenna system of claim 1 wherein the second balanced antenna comprises two antenna pieces, each attached to an opposite side of the printed circuit board assembly.

7. The antenna system of claim 6 wherein each of the two antenna pieces is soldered to a pad on opposite sides of the printed circuit board assembly, wherein the pads are connected to form an inductive connecting element.

8. The antenna system of claim 1 wherein the second balanced antenna comprises a center fed dipole antenna having capacitive end plates on opposite sides of the printed circuit board assembly, the capacitive end plates being connected by an inductive connecting element.

9. The antenna system of claim 1 wherein the second balanced antenna comprises two approximately symmetrical dipole ends positioned approximately equidistant from the printed circuit board assembly on opposite sides of the printed circuit board assembly.

10. The antenna system of claim 1 wherein the second balanced antenna has a C-shaped cross section, and is disposed around an edge of the printed circuit board assembly.

11. The antenna system of claim 1 wherein the first antenna operates in a WiMAX frequency band and the second balanced antenna operates in a WiFi frequency band.

12. The antenna system of claim 1 wherein the second balanced antenna comprises a plurality of antenna elements, each operatively coupled to a different antenna port, and one or more connecting elements electrically connecting the antenna elements such that electrical currents on one antenna element flow to a connected neighboring antenna element and approximately bypass the antenna port coupled to the connected neighboring antenna element, the electrical currents flowing through the one antenna element and the connected neighboring antenna element being approximately equal in magnitude, such that an antenna mode excited by one antenna port is approximately electrically isolated from a mode excited by another antenna port at a given desired signal frequency range.

13. The antenna system of claim 1 further comprising one or more additional antennas attached to an edge of the printed circuit board assembly such that the ground plane of the printed circuit board assembly serves as a counterpoise for the one or more additional antennas.

14. The antenna system of claim 1 wherein the first antenna and the second balanced antenna are in close proximity, and wherein near fields created by the first antenna and the second balanced antenna do not overlap thereby reducing Specific Absorption Rate (SAR) values when both antennas are used for simultaneous transmission.

15. An antenna system for a portable electronics device having two or more radios operating independently and simultaneously, the antenna system comprising:

a printed circuit board assembly having a ground plane;

a first antenna provided on the printed circuit board assembly, the first antenna being fed from a portion of the printed circuit board assembly such that the ground plane of the printed circuit board assembly serves as a counterpoise for the first antenna; and a second balanced antenna comprising two approximately symmetrical dipole ends positioned approximately equidistant from the printed circuit board assembly on opposite sides of the printed circuit board assembly, the dipole ends being excitable to an electrical potential of equal magnitude and opposite sign, resulting in an approximately neutral potential at the ground plane to approximately minimize coupling to the ground plane to increase isolation between the first antenna and the second balanced antenna.

16. The antenna system of claim 15 wherein the dipole ends are oriented such that an axis of polarization is approximately normal to the ground plane of the printed circuit board assembly.

17. The antenna system of claim 15 wherein the first antenna and the second balanced antenna are provided at opposite ends of the printed circuit board assembly.

18. The antenna system of claim 15 wherein the first antenna and the second balanced antenna are provided at a same end of the printed circuit board assembly.

19. The antenna system of claim 15 wherein the second balanced antenna comprises a conductive foil pattern printed on a carrier attached to the printed circuit board assembly.

20. The antenna system of claim 15 wherein the second balanced antenna comprises a stamped metal part.

21. The antenna system of claim 15 wherein the second balanced antenna comprises two antenna pieces, each attached to a pad on an opposite side of the printed circuit board assembly, wherein the pads are connected to form an inductive connecting element.

22. The antenna system of claim 15 wherein the second balanced antenna has a C-shaped cross section, and is disposed around an edge of the printed circuit board assembly.

23. The antenna system of claim 15 wherein the first antenna operates in a WiMAX frequency band and the second balanced antenna operates in a WiFi frequency band.

24. The antenna system of claim 15 wherein the second balanced antenna comprises a plurality of antenna elements, each operatively coupled to a different antenna port, and one or more connecting elements electrically connecting the antenna elements such that electrical currents on one antenna element flow to a connected neighboring antenna element and approximately bypass the antenna port coupled to the connected neighboring antenna element, the electrical currents flowing through the one antenna element and the connected neighboring antenna element being approximately equal in magnitude, such that an antenna mode excited by one antenna port is approximately electrically isolated from a mode excited by another antenna port at a given desired signal frequency range.

25. The antenna system of claim 15 further comprising one or more additional antennas attached to an edge of the printed circuit board assembly such that the ground plane of the printed circuit board assembly serves as a counterpoise for the one or more additional antennas.

26. The antenna system of claim 15 wherein the first antenna and the second balanced antenna are in close proximity, and wherein near fields created by the first antenna and the second balanced antenna do not overlap thereby reducing Specific Absorption Rate (SAR) values when both antennas are used for simultaneous transmission.

27. A communication device, comprising:

a plurality of radios; and an antenna system coupled to the plurality of radios, wherein the antenna system comprises:

a printed circuit board assembly having a ground plane;

a first antenna provided on the printed circuit board assembly, the first antenna being fed from a portion of the printed circuit board assembly such that the ground plane of the printed circuit board assembly serves as a counterpoise for the first antenna; and a second balanced antenna comprising two approximately symmetrical dipole ends positioned approximately equidistant from the printed circuit board assembly on opposite sides of the printed circuit board assembly, the dipole ends being excitable to an electrical potential of equal magnitude and opposite sign, resulting in an approximately neutral potential at the ground plane to approximately minimize coupling to the ground plane to increase isolation between the first antenna and the second balanced antenna.

* * * * *